US005403096A

United States Patent [19]

Aagesen

[11] Patent Number: 5,403,096

[45] Date of Patent: Apr. 4, 1995

[54] MULTI-WALL BAG FOR GRANULATED PESTICIDES

[75] Inventor: Gary Aagesen, Parkville, Mo.

[73] Assignee: Miles Inc., Pittsburgh, Pa.

[21] Appl. No.: 122,252

[22] Filed: Sep. 15, 1993

[51] Int. Cl.[6] ..... B65D 30/08

[52] U.S. Cl. ..... 383/111; 383/1; 383/109; 206/524.7

[58] Field of Search ..... 206/0.5, 524.7; 383/1, 383/37, 109, 111

[56] References Cited

U.S. PATENT DOCUMENTS

| | | | |
|---|---|---|---|
| 3,294,224 | 12/1966 | Horwitz | 206/0.5 |
| 3,790,067 | 2/1974 | Scheier | 383/1 |
| 3,892,905 | 7/1975 | Albert | 206/524.7 |
| 3,934,587 | 1/1976 | Gordon | 383/1 |
| 4,041,209 | 8/1977 | Scholle | 428/500 |
| 4,065,049 | 12/1977 | Achelpohl et al. | 383/111 |
| 4,806,261 | 2/1989 | Ciallella et al. | 206/0.5 |
| 4,828,744 | 5/1989 | Kaufmann et al. | 206/524.7 |
| 5,007,233 | 4/1991 | Bose | 53/449 |
| 5,222,595 | 6/1993 | Gouge et al. | 206/524.7 |
| 5,279,421 | 1/1994 | Gouge et al. | 206/524.7 |

FOREIGN PATENT DOCUMENTS

| | | | |
|---|---|---|---|
| 226569 | 9/1989 | Japan | 383/111 |

*Primary Examiner*—David T. Fidei

*Attorney, Agent, or Firm*—Joseph C. Gil; Lyndanne M. Whalen; Godfried R. Akorli

[57] ABSTRACT

An environmentally safe, multi-wall disposable bag for a granulated pesticide which is made of: a) a first outer bag composed of paper having a closed end, an open end, an inner, uncoated surface and an outer surface, and b) a second bag composed of a water soluble material having a closed end, an open end, an inner surface and an outer surface which is positioned within outer bag a) in a manner such that in the open position, its opening extends beyond that of outer bag a).

7 Claims, 1 Drawing Sheet

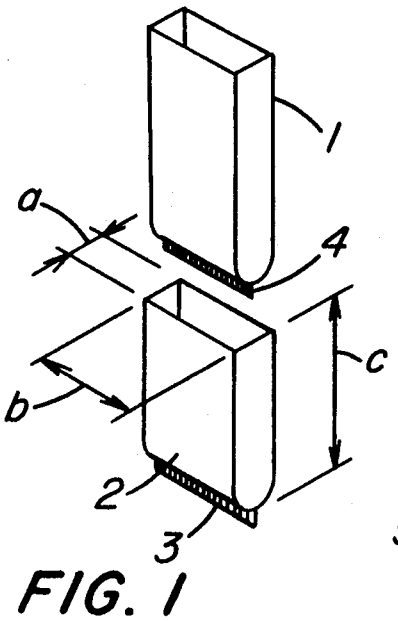
FIG. 1
FIG. 2
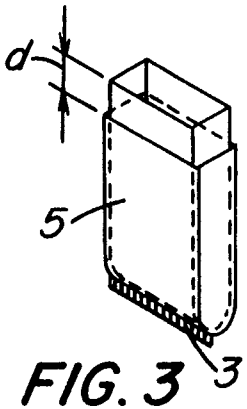
FIG. 3
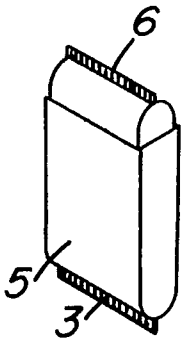
FIG. 4
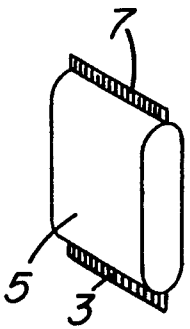
FIG. 5

MULTI-WALL BAG FOR GRANULATED PESTICIDES

BACKGROUND OF THE INVENTION

The present invention relates to an environmentally safe, multi-wall disposable bag for a granulated pesticide.

Granulated products are shipped and stored in a variety of different types of containers. Among the most commonly used containers for relatively small amounts of granulated materials is a multi-wall bag. Examples of such multi-wall bags are disclosed in U.S. Pat. Nos. 4,041,209 and 5,007,233.

Pesticides in granulated form are also shipped and stored in multi-wall paper bags. One of the disadvantages of these bags is the presence of residual pesticide. Because most unused pesticides require special disposal methods, bags having residual pesticide must be disposed of in landfills or by some other approved method. The expense of such disposal has led many pesticide suppliers to make their pesticides available in returnable, recyclable plastic containers. However, such containers are more expensive than the traditional multi-wall bags and still require special handling and treatment.

It would therefore be advantageous to develop a multi-wall bag for pesticides which could be disposed of at the site where it is used without the need to return, recycle or landfill the used bag.

SUMMARY OF THE INVENTION

It is an object of the present invention to provide a multi-wall bag for granulated pesticides which is environmentally safe.

It is another object of the present invention to provide a bag for granulated pesticides which may be disposed of at the site where the pesticide is applied in an environmentally sound manner.

It is a further object of the present invention to provide a bag for granulated pesticides which need not be recycled or specially treated prior to disposal.

These and other objects which will be apparent to those skilled in the art are accomplished by the multi-wall disposable bag of the present invention which is made up of a) an outer bag composed of paper having sufficient strength to contain the amount of pesticide to be placed in the container and b) a second, inner bag composed of a water soluble material such as polyvinyl alcohol, polyethylene oxide or water soluble paper. The inner bag b) is positioned within the outer bag a) in a manner such that when the multi-wall bag is in its open position, the walls of inner bag b) extend beyond the opening of the outer bag a). After the pesticide which had been stored in the multi-wall bag of the present invention is completely used, the inner and outer bags are separated. The inner, water soluble bag b) may then be buried in soil which has been treated with the pesticide which had been present in the multi-wall bag. The outer paper bag a) which has no residual pesticide present may be disposed of by burning it or by any of the other disposal methods suitable for regular, non-hazardous paper waste.

BRIEF DESCRIPTION OF THE DRAWINGS

FIG. 1 illustrates the inner and outer bags of the multi-wall bag of the present invention separately.

FIG. 2 illustrates the insertion of the inner bag into the outer bag of the multi-wall bag of the present invention.

FIG. 3 illustrates an open multi-wall bag of the present invention.

FIG. 4 illustrates the multi-wall bag of the present invention with the inner bag sealed prior to folding of that inner bag to make it fit into the outer bag.

FIG. 5 illustrates the multi-wall bag of the present invention when it has been completely sealed, i.e., the sealed inner bag has been folded into the outer bag and the outer bag has been sealed.

DETAILED DESCRIPTION OF THE PREFERRED EMBODIMENTS OF THE PRESENT INVENTION

The preferred embodiment of the present invention is illustrated in FIGS. 1–5. The multi-wall bag of the present invention will be described below with reference to those Figures.

The environmentally safe, multi-wall disposable bag 5 for a granulated pesticide of the present invention is made up of at least one paper bag or outer bag 2 which is sealed at one end (seal 3) and a bag which is made of a water-soluble material such as polyvinyl alcohol or an inner bag 1 which is sealed at one end (seal 4). Bag 1 and bag 2 are each independently sealed, i.e., there is no seal which is common to both. The paper bag 2 and water soluble bag 1 need not be joined or bonded together at any point. It is preferred, however, that bag 1 and bag 2 be weakly bonded at several spots to facilitate filling of the multi-wall bag 5 with the granulated pesticide. Bag 1 and bag 2 must not, however, be so strongly bonded together that after all of the pesticide has been used, the individual bags can not be separated. The inner bag 1 must have walls which extend beyond the opening of paper bag 2 by distance d (FIG. 3) when bag 1 and bag 2 are each unsealed at the open end. Distance d is such that the walls of bag 1 may be sealed and placed completely within bag 2 without preventing the sealing of bag 2.

The outer bag 2 of the multi-wall bag of the present invention 5 may be made of any of the known papers which have sufficient strength to remain intact during shipping and handling of filled multi-wall bag 5. It is preferred that the paper used to make bag 2 be kraft paper having a basic weight of from about 40 lb. per 1000 square feet to about 50 lb. per 1000 square feet, preferably, 3 or 4 plies of paper each having a 50 pound per 1000 square feet basic weight. Natural or kraft paper may be used to make other bag 2 of the present invention.

Outer, paper bag 2 may be coated or uncoated on either or on both sides. It is, however, preferred that one side, preferably, the wall of bag 2 which will be visible when the multi-wall bag 5 is in use, be coated to enhance its strength and to protect the contents of the multi-wall bag 5 and the water soluble bag 1 from moisture. This coating material must, however, be a material which does not require a special type of disposal. It is preferred that the coating material be such that the coated paper bag 2 be burnable without generating hazardous fumes and without violating any environmental regulation. Polyethylene is an example of a material which may be used as a coating for the multi-wall bags 5 of the present invention. Other suitable coating materials include: starches, resins, latex compositions and waxes.

The outer, paper bag 2 may be of any thickness which will result in sufficient strength to withstand the weight of the bag contents when subjected to shipping conditions.

Paper bag 2 may be sealed at seal 3 by any of the known sealing techniques. Examples of suitable sealing methods include sewn over tape and pinch style heat sealing.

The water soluble bag 1 may be made of any material which will decompose when exposed to rain, snow and atmospheric moisture within a short period of time. Such materials generally have a water solubility such that they are completely dissolved in a period of from about 1 minute to about 5 minutes, preferably from about 1 to about 2 minutes. Examples of specific materials which are sufficiently water soluble to be useful as inner bag 1 include: polyvinyl alcohols, polyethylene oxides and water soluble paper. Polyvinyl alcohols having an acetate content of from about 10 to about 38% by weight are particularly preferred materials for inner bag 1. A commercially available polyvinyl alcohol which has been found to be particularly useful for the production of bag 1 is that which is sold under the name "MONOSOL M-7030" by ChrisCraft Ind.

Specific commercially available polyethylene oxides which are useful for the production of bag 1 include those sold under the names POLYOX (by Union Carbide) and QUIK-SOL (by Polymer Films, Inc.).

A specific commercially available water soluble paper which may be used to produce bag 1 is that which is sold under the name DISSOLVO-POUGH by Gilbreth International.

Bag 1 must be thick enough and strong enough to contain the amount of pesticide to be placed therein under shipping and use conditions without puncturing or leaking. Generally, this bag 1 will have walls which are at least 1.5 mils (0.38 mm) thick, preferably from about 1.5 to about 2.5 mils (0.064 mm) thick. Bag 1 must have dimensions which are sufficiently less than a and b of bag 2 (FIG. 1) to permit the water soluble bag 1 to be inserted inside of paper bag 2. The water soluble bag 1 must have a height greater than c of bag 2 so that bag 1 will extend beyond the opening of the outer bag 2 both when filled and unfilled.

The bottom of bag 1 may be sealed at seal 4 by any of the known techniques. The preferred method for sealing this water soluble material is induction heat sealing.

In assembling the bags of the present invention, the water soluble bag 1 is inserted into the paper bag 2 in a manner such that seal 4 of bag 1 is brought into contact with seal 3 of bag 2. (See FIGS. 1 and 2.) An adhesive may be applied between the bags 1 and 2 at selected points to prevent bag 1 from slipping into bag 2 during the filling operation but use of such adhesive is optional. The resultant multi-wall bag 5 is then filled with a granulated pesticide by any of the filling techniques known to those skilled in the art. Upon completion of the filling operation, bag 1 is sealed at seal 6 (FIG. 4) in a manner such that any air present will not prevent rolling of bag 1 to make it fit within bag 2. This sealing may be done by any of the known methods. Induction heat sealing is a particularly preferred method. The walls of completely sealed bag 1 which extend beyond the opening of unsealed outer bag 2 are then rolled or folded in a manner such that they no longer extend beyond the opening of bag 2. The paper bag 2 is then sealed at seal 7 by any one of the known methods. The TOS (i.e., tape over sewn) method is preferred.

In use, seal 7 of the paper, outer bag 2 is first broken and bag 2 is opened. Then seal 6 of bag 1 is broken and bag 1 is opened. The granulated pesticide is applied in the appropriate manner. After the pesticide has been completely used, bags 1 and 2 are separated. The water soluble bag 1 is buried in the area to which the pesticide has been applied. The paper bag 2 may be disposed of by burning or in any other manner which is appropriate for non-hazardous waste material.

Having thus described my invention, the following Examples are given as being illustrative thereof. All parts and percentages are parts by weight and percentages by weight, unless otherwise indicated.

EXAMPLE

A multi-wall bag 5 corresponding to that shown in FIG. 5 was made from 4 plies of kraft paper having a basic weight of 50 pounds per 1000 square feet which had been coated on one side (the side which was to become the exterior of bag (2) with the polyvinyl alcohol sold under the name Monosol 7030 in the form of a film having a thickness of 1.5 mil. The paper bag (2) was sealed at seal 3 by the TOS (tape over sewn) technique. The dimensions of this paper bag 2 were 16 inches long (b) 6 inches wide (a) and 30 inches high (c). The water soluble bag 1 was sealed at seal 4 by heat sealing with an impulse heat sealer. The dimensions of this water soluble bag 1 were 22"×33". Bag 1 was then inserted in bag 2 and the resultant multi-wall bag 5 was filled with 50 pounds of the insecticide AZTEC (21% granular). Bag 1 was then sealed at seal 6 by impulse heat sealing and rolled to make it fit within paper bag 2. Paper bag 2 was then sealed at seal 7) by TOS (tape over sewn).

The filled multi-wall bag 5 was then transported to a site where the Aztec insecticide was to be applied. The seal 7 of outer paper bag 2 was broken, then the seal 6 of water soluble bag 1 was broken and bag 1 was unrolled to its open position. The contents of the multi-wall bag 5 were then applied to the soil in an appropriate manner. After the multi-wall bag 5 was empty bags 1 and 2 were separated. The inner, water soluble bag 1 was partially buried in the ground in the area which had just been treated with the insecticide so that it would be exposed to rain but would not be blown away. The paper bag 2 was burned. All signs of the water soluble bag 1 were gone after the first rain.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. An environmentally safe, multi-wall disposable bag for a granulated pesticide comprising:

a) a first outer bag composed of paper having a closed end, an opened end, an inner, uncoated surface and an outer surface, and b) a second bag composed of a water soluble material having a closed end, an open end, and an inner surface and an outer surface which is positioned within an outer bag a) in a manner such that in the open position, the opening extends beyond that of the outer bag a), and in which the second bag b) is attached at selected spots to the outer bag a) to secure it from slipping and promote ease in filling of the empty bag.

2. The bag of claim 1 in which the outer bag a) is 3 plies of 50 lb. per 1000 square feet.

3. The bag of claim 1 in which the inner liner b) is approximately 1.5 mils thick.

4. The bag of claim 1 in which the water soluble material used for b) is a polyvinyl alcohol.

5. The bag of claim 4 in which the polyvinyl alcohol from which inner liner b) is made has a solubility such that it will decompose upon exposure to the water within 5 minutes.

6. The bag of claim 1 in which the inner liner b) is made of a polyvinyl alcohol having an acetate content of from about 10 to about 38% by weight.

7. The bag of claim 1 in which the outer surface of bag a) is coated with a material selected from the group consisting of polyethylenes, starches, resins, latex compositions and waxes.

* * * * *